United States Patent [19]

Gelbard

[11] Patent Number: 4,591,354

[45] Date of Patent: May 27, 1986

[54] APPARATUS FOR FOLDING SHEET MATERIALS

[75] Inventor: Edward Gelbard, Monte Carlo, Monaco

[73] Assignee: Wilverly Mansions I.B.V., Netherlands

[21] Appl. No.: 640,933

[22] Filed: Aug. 15, 1984

[51] Int. Cl.[4] ..... B31F 1/00

[52] U.S. Cl. ..... 493/439; 493/446; 493/455; 493/476; 493/248

[58] Field of Search ..... 493/446, 447, 455, 456, 493/459, 460, 461, 248, 476, 439, 440; 270/94, 86

[56] References Cited

U.S. PATENT DOCUMENTS

| | | | |
|---|---|---|---|
| 229,479 | 6/1880 | Scholfield | 493/446 |
| 4,285,686 | 8/1981 | Ambler | 493/447 |
| 4,304,561 | 12/1981 | Shingo | 493/456 |

*Primary Examiner*—Francis S. Husar
*Assistant Examiner*—David B. Jones
*Attorney, Agent, or Firm*—Darby & Darby

[57] ABSTRACT

Apparatus is provided for automatically effecting a widthwise folding of a long, flexible web advanced therethrough. The web is trained about a first roller at a point where the folding begins and about a second roller at a point where the folding ends. A displacement edge or bar is mounted in a fixed location equidistant from the first and second rollers, and a portion of the web is trained about the displacement edge or bar during the folding. Webs of different widths are accommodated by adjusting the positions of the first and second rollers without changing the shapes of three similar triangles. The first triangle is defined by a first point where a first edge of the web intersects the first roller, a second point where the same edge of the web intersects the second roller, and a third point where the opposite edge of the web intersects the first roller. The second triangle is defined by the first point, a fourth point where the first edge of the web intersects the displacement bar or edge, and a fifth point midway between the first and second points. The third triangle is defined by the second, fourth and fifth points. The distance between the fourth and fifth points is half the distance between the first and second points.

16 Claims, 6 Drawing Figures

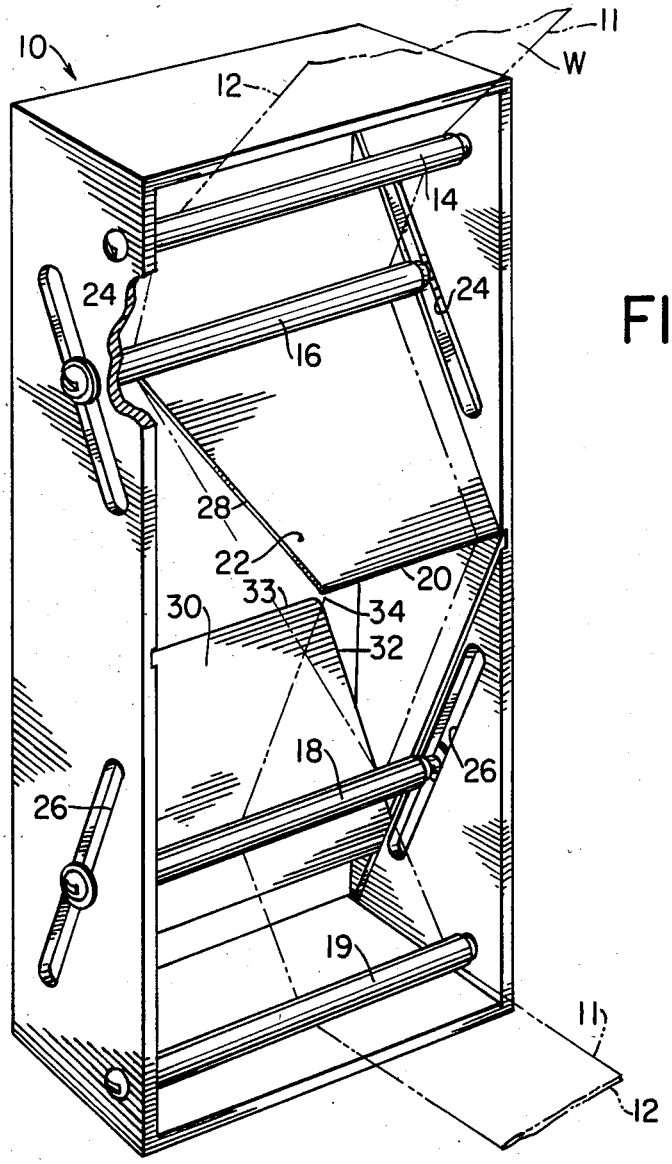
FIG. 1
FIG. 4
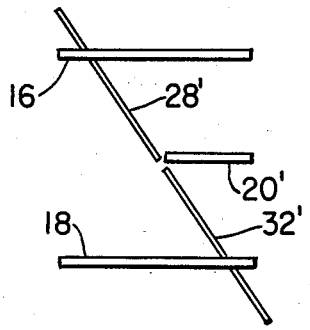

APPARATUS FOR FOLDING SHEET MATERIALS

BACKGROUND OF THE INVENTION

This invention relates to an apparatus and method for folding sheet materials such as plastic film of the type used, for example, to manufacture packaging materials and the like.

In the manufacture of polyethylene bags, it is conventional to fold the sheet material widthwise. This may be done as the material is extruded, or the material may be first stored in large rolls and then folded. In what is believed to be the most widely used commercial folding process, the unfolded film is shaped around a triangular form and the folded film removed continuously from the apex of the triangle at right angles to the direction of feed. See U.S. Pat. Nos. 229,479 of Scholfield and 4,285,686 of Ambler. When folding stretchable plastic materials (such as polyethylene), this process leads to excessive waste because of undesired stretching of the film as it is removed from the apex of the triangular form.

Long tubes of sheets folded in this manner may be heat-sealed from edge to edge at longitudinally-spaced-apart intervals and then cut just above or below the seals to form simple bags without gussets and with minimally reinforced bottoms. Preferably, however, the sheets are folded again one or more times in the same manner in order to provide bags that have a more complicated but stronger construction.

In order to reduce the waste, which is particularly significant in cases where the plastic sheet material is being folded as it comes from an extrusion machine, the assignee of the present invention developed and used a folding apparatus comprising forming blades, which are universally adjustable, in conjunction with a deflection bar which enables the geometry of the device to be adjusted in such a way that films of variable width can be folded continuously and with substantially reduced waste as compared to the above-described process in which a triangular form is employed. The use of these forming blades and deflection bar, however, requires a fairly sophisticated adjustment procedure to accommodate sheeting materials of different widths. If well-trained labor is not available, the need to adjust the blades and deflection bar can result in excessive waste where the apparatus is used in conjunction with an extrusion device or the like wherein the plastic material is continuously supplied to the folding apparatus.

OBJECTS OF THE INVENTION

The main object of the invention is to provide a folding apparatus of the type described in which waste is reduced.

A further object is to provide folding apparatus of the type described wherein adjustments for sheet materials of different widths are relatively simple and can be quickly accomplished by unskilled labor.

SUMMARY OF THE INVENTION

The foregoing and other objects are attained in accordance with the invention by the provision of first training means, the web being trained about the first training means before the folding, second training means mounted in spaced-apart relation to the first training means, the web being trained about the second training means after the folding, and displacement means mounted in a fixed location equidistant from the first and second training means, a portion of the web being trained about the displacement means during the folding.

A first triangle is defined by a first point where a first edge of the web intersects the first training means, a second point where the same edge of the web intersects the second training means, and a third point where the opposite edge of the web intersects the first training means.

A second triangle is defined by the first point, a fourth point where the first edge of the web intersects the displacement means, and a fifth point midway between the first and second points.

A third triangle is defined by the second, fourth and fifth points.

The triangles are similar in a geometric sense, and the distance between the fourth and fifth points is half the distance between the first and third points.

Adjustment means is provided in accordance with the invention for accommodating webs of different widths by adjusting the positions of the first and second training means without changing the shapes of the triangles.

BRIEF DESCRIPTION OF THE DRAWING

A better understanding of the invention can be gained from a consideration of the following detailed description of the preferred embodiments thereof, in conjunction with the appended figures of the drawing, wherein:

FIG. 1 is a perspective view, partly broken away, of apparatus constructed in accordance with the invention;

FIG. 4 is a fragmentary view in front elevation showing another embodiment of apparatus in accordance with the invention;

DESCRIPTION OF THE PREFERRED EMBODIMENTS

Figure 3:
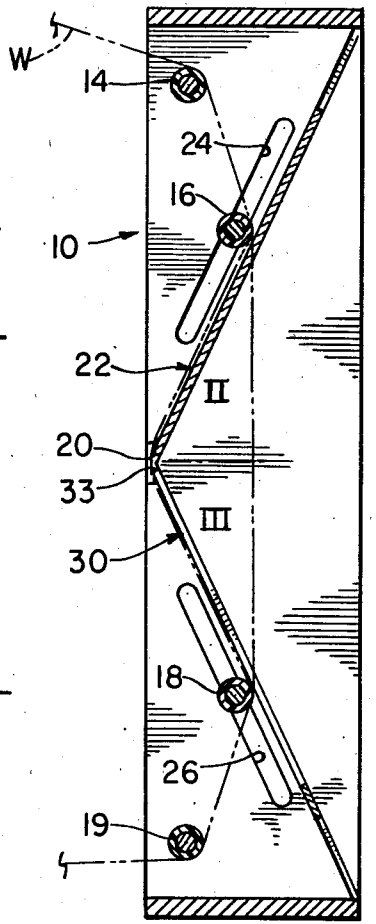
FIG. 3 is a vertical sectional view taken along the line 3—3 of FIG. 2 and looking in the direction of the arrows.
Figure 2:
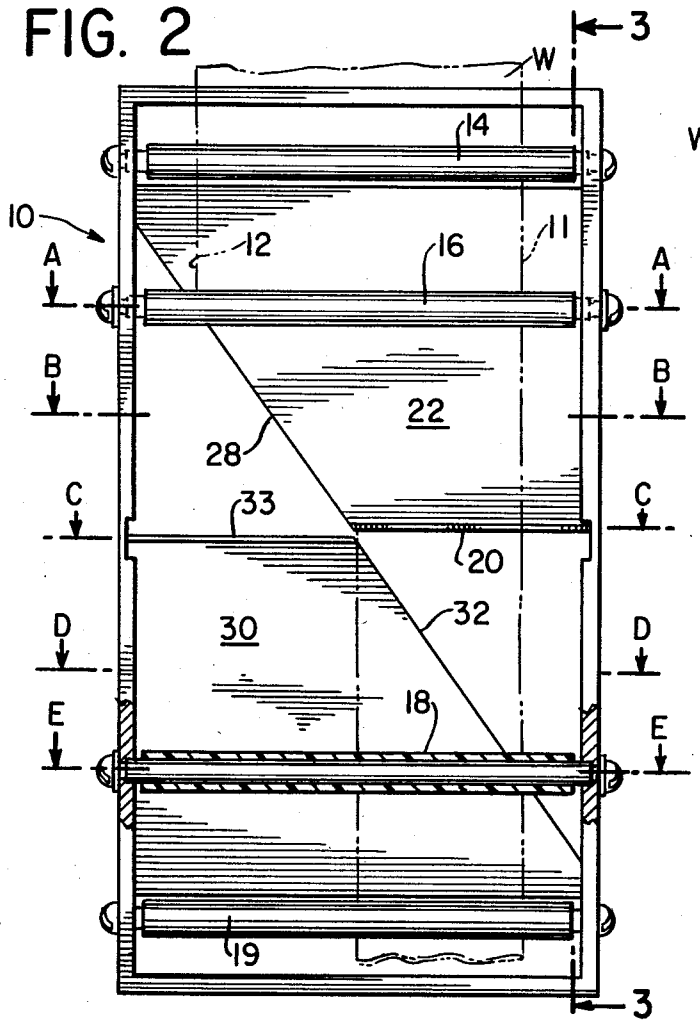
FIG. 2 is a vertical front elevation of the apparatus of FIG. 1.

FIGS. 1–3 disclose a preferred embodiment of apparatus 10 constructed in accordance with the invention. The apparatus 10 is intended to fold a long, flexible web W having edges 11 and 12 in a widthwise direction. More particularly, the second edge 12 of the web W is folded rearwardly (as seen in FIG. 1) to a position in which it underlies the first edge 11. The web W thus becomes folded in half about its longitudinal center line.

The web W may or may not have been previously folded before arriving at the apparatus 10. Any such previous folding is preferably, though not necessarily, accomplished by means of other apparatus (not shown) similar to the apparatus 10. For purposes of the following discussion, the web W will be considered as not having previously been folded. However, the following discussion is equally applicable to cases where the web W has been previously folded if "unfolded" in the discussion is read as "once folded" and "folded" is read as "twice folded"; or if "unfolded" is read as "twice folded" and "folded" is read as "three times folded", etc.

The unfolded web W is initially trained about a guide roller 14. It is then trained about first training means such as a roller 16 while still in an unfolded condition. Second training means such as a roller 18 is mounted in spaced-apart relation to the first training means 16, and the web W is trained about the second training means 18 after the folding has been completed. The folded web is trained about a guide roller 19 and then passes on to downstream apparatus (not shown). Ideally, the folding of the web W begins precisely at the roller 16 and is completed precisely at the roller 18, although it is within the scope of the invention to allow some tolerance if less than perfect results are acceptable.

Displacement means 20 is mounted in a fixed location equidistant from the first and second training means 16, 18, and a portion (substantially half the width) of the web W is trained about the displacement means 20 during the folding process.

In FIGS. 1–3, the displacement means 20 is simply the edge 20 of a fixed plate 22. In another embodiment, described below in connection with FIG. 4, the displacement means comprises a fixed bar 20'. Other structure, such as rollers, etc., can also be used. Similarly, the training means 16 and 18 are shown in FIGS. 1–3 as rollers, but non-rotating bars and other structure can be substituted therefor.

Figure 5:
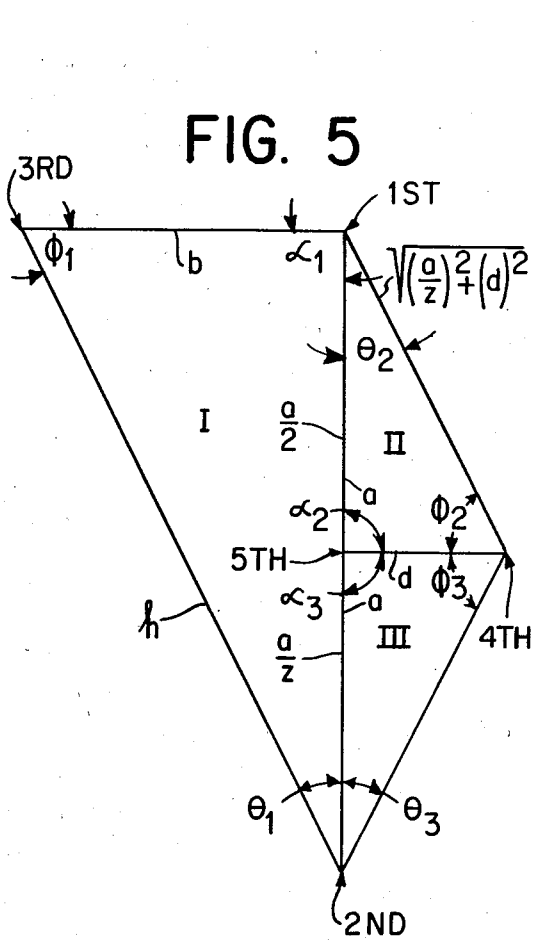
FIG. 5 is a diagram of triangles referred to in order to facilitate an understanding of the invention.

In order to understand the concept of the invention, it is helpful to refer to the various triangles, points an angles illustrated in FIG. 5. A first triangle I is defined by a first point 1st where the first edge 11 (FIG. 1) of the web W intersects the first training means 16, a second point 2nd where the same edge 11 of the web W intersects the second training means 18, and a third point 3rd where the opposite edge 12 of the web W (FIG. 1) intersects the first training means 16.

A second triangle II is defined by the first point 1st, a fourth point 4th where the first edge 11 of the web W intersects the displacement means 20, and a fifth point 5th midway between the first and second points 1st and 2nd, respectively.

A third triangle III is defined by the second, fourth and fifth points 2nd, 4th and 5th, respectively.

Triangle I may be thought of as lying in the plane defined by the parallel rollers 16 and 18. Triangle II and III may be thought of as lying in a plane extending at right angles to the plane of triangle I, the respective hypotenuses of triangles II and III being considered as lying along the path followed by the edge 11 of the web W. However, to facilitate the representation of the triangles, they are shown all in one plane in FIG. 5.

The triangles I, II and III are similar because of the construction of the apparatus, as set forth in greater detail below. Specifically, when the apparatus is properly set up, angles $\phi_1=\phi_2=\phi_3$; angles $\theta_1=\theta_2=\theta_3$; and right angles $\alpha_1=\alpha_2=\alpha_3$.

In setting up the apparatus, the distance d between the fourth and fifth points 4th and 5th is made equal to one-half the width of the web W: i.e., is made equal to one-half the distance b between the first and the third points 1st and 3rd. Similarly, the distance a between the first and second points 1st and 2nd is divided equally into two parts each having a length a/2.

In each of the triangles I, II and III, the angle $\alpha_1$, $\alpha_2$ or $\alpha_3$ remains a right angle as the size of the triangle varies; i.e., as a web of different width is substituted, and as the rollers or other training means 16 and 18 are moved equal distances along tracks 24 and 26, respectively (FIGS. 1 and 3). These tracks 24 and 26 are respectively parallel to the directions in which the rollers 16 and 18 are intended to move and to the hypotenuses of triangles II and III.

The fixed plate 22 has a diagonal edge 28, and another fixed plate 30 has a diagonal edge 32. Projections of the edges 28 and 32 into the plane of triangle I lie substantially in the same straight line (i.e., they are collinear) and together correspond to the hypotenuse h of triangle I. As indicated above, the distance b between the first and third points 1st and 3rd equals the width of the web W. The displacement d equals the distance between the fourth point 4th, which is a fixed point shown, for example, in FIGS. 3 and 5, and the fifth point 5th, which is midway between the first and second points 1st and 2nd.

In folding the web as described above, a given point on the edge 11 of the web W must move the same distance through the apparatus 10 as a point directly opposite thereto on the edge 12, in order to avoid stretching of the web W in a region adjacent to one edge or the other. Thus, the distance between the first and fourth points 1st and 4th plus the distance between the fourth and second points 4th and 2nd must be equal to the distance between the third and second points 3rd and 2nd.

By the Pythagorean Theorem, the square of the hypotenuse of any right triangle is equal to the sum of the squares of the other two sides of the same triangle. The distance between the first and fifth points 1st and 5th is a/2, since the fifth point is selected to be midway between the first and second points. The second side of triangle II is d, which corresponds to the displacement effected by the fixed point 4th from the plane of the first triangle I in which the rollers 16 and 18 lie. Therefore, the distance between the first and fourth points 1st and 4th is $$\sqrt{\left(\frac{a}{2}\right)^2+(d)^2},$$

as indicated in FIG. 5. From what is indicated above, twice this distance must be equal to h, which is the distance between the third and second points 3rd and 2nd. That is, $$2\sqrt{\left(\frac{a}{2}\right)^2+(d)^2}=h$$

It can be proved that, if this is the case, then d=b/2. The proof is as follows:

$$\text{Let } 2\sqrt{\left(\frac{a}{2}\right)^2+(d)^2}=h \tag{1}$$

Squaring both sides of equation (1) gives:

$$a^2+4d^2=h^2 \tag{2}$$

By the Pythagorean Theorem, in triangle I (FIG. 5), $$h^2=a^2+b^2 \quad (3)$$

combining equations (2) and (3) gives:

$$a^2+4d^2=a^2+b^2 \quad (4)$$

Solving equation (4) for $d^2$ gives:

$$d^2=\frac{a^2+b^2-a^2}{4} \quad (5)$$

$$=\frac{b^2}{4}$$

Taking the square root of both sides of equation (5) gives:

$$d=b/2 \quad (6)$$

The adjustment means including the tracks 24 and 26 accommodates webs of different widths by adjusting the positions of the first and second training means 16 and 18 without changing the shapes of the triangles I, II and III. Specifically, once the apparatus is correctly set up, the rollers or other training means 16 and 18 are always moved through equal distances and in directions which are determined by the tracks 24 and 26. These directions, together with the directions of the projections of the edges 28 and 32 of the plates 22 and 30, respectively, onto the plane of triangle I, ensure that the triangles I, II and III remain similar.

In order to facilitate easy adjustment of the rollers or other adjustment means 16 and 18 through equal distances, it is possible, though not necessary, to include a mechanical or other linkage (not shown) between the rollers. Alternatively, the personnel who operate the apparatus 10 may be instructed always to move the rollers 16 and 18 through equal distances in accommodating webs of different widths. As a check on correct adjustment, the rollers 16 and 18 should always be equal distances from the edge 20, which corresponds to the fourth point 4th, the displacement d should always be equal to half the width b of the web W, and the web W should be centered widthwise with respect to the apparatus 10.

The procedure to be followed in setting up the apparatus of FIGS. 1–3 is therefore as follows:

(1) Measure the width b of the web W to be folded by the apparatus 10.

(2) Taking care to ensure that the rollers 16 and 18 are equidistant from the edge 20 and that the eges 20 and 28 and the centerline of the web W intersect at a common point 34 (FIG. 1), adjust the rollers 16 and 18 so that the displacement d is equal to b/2.

If the angles $\phi_1$, $\phi_2$, $\phi_3$ and $\theta_1$, $\theta_2$, $\theta_3$ are such that the apparatus is correctly adjusted for a first web, the procedure described above will ensure that the apparatus will be properly adjusted for all webs (provided they are not too wide to be accommodated by the rollers).

In order to ensure that the angles $\phi_1$, $\phi_2$ and $\phi_3$ are properly related to the angles $\theta_1$, $\theta_2$ and $\theta_3$, it is only necessary to ensure that triangles I, II and III are similar.

As FIG. 4 shows, the edge 20 of the plate 22 can be replaced by a bar 20' which serves as the displacement means. The bar 20' is parallel to the rollers 16 and 18.

In FIGS. 1 and 2, the plate 22 has a second edge 28 of which a projection onto the plane of the first triangle I is parallel to a line connecting the second and third points 2nd and 3rd. This edge 28 is replaced by a bar 28' in FIG. 4.

Between the training means 20 (FIGS. 1 and 2) and the second roller 18, the edge 32 of the plate 30 acts as guide means to facilitate the completion of the folding of the web W. The top edge 33 of the plate 30 is parallel to and substantially collinear with the edge 20. The web W passes in front of the edge 20 and behind the edge 33 (as seen in FIG. 1).

Figure 6:
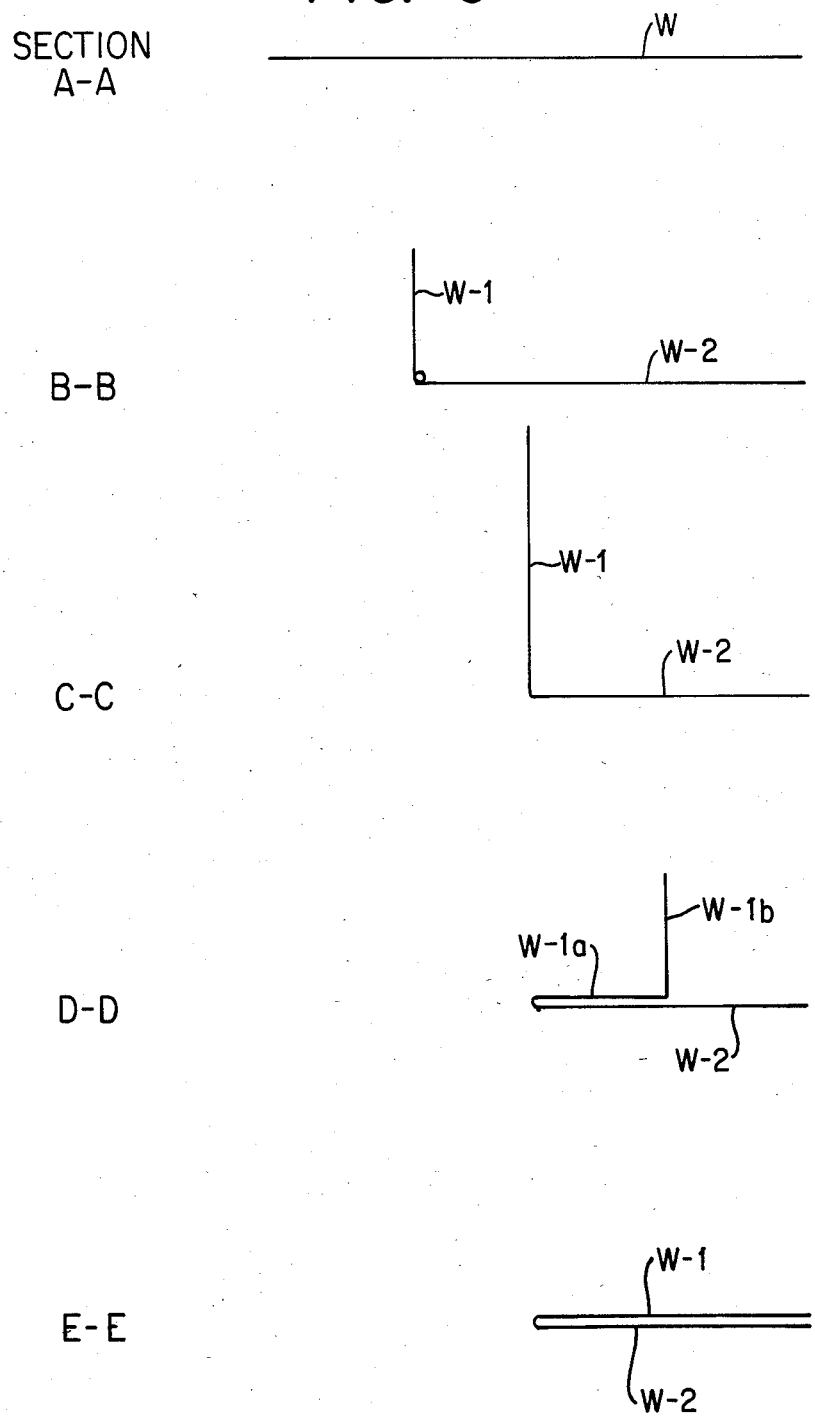
FIG. 6 is a diagram showing the progressive folding of a web in accordance with the invention at sections A—A, B—B, C—C, D—D and E—E of FIG. 2, looking in the direction of the arrows.

FIG. 6 shows the progressive folding of the web W in accordance with the invention at sections A—A, B—B, C—C, D—D and E—D of FIG. 2.

At Section A—A, the web W is tangent to the roller 16 and flat.

At Section B—B, a part W-1 of the web has begun to fold to the rear with respect to the remaining part W-2.

The plane in which the part W-1 of the web lies does not form right dihedral angles with the planes in which the remainder of the web between the rollers 16 and 18 lies, since such remainder of the web lies in planes respectively defined by the plates 22 and 30, both of which are normal to the plane of FIG. 3, and any plane normal to both plates 22 and 30 would have to be parallel to the plane of FIG. 3—a condition which the plane of the folded part W-1 of the web fails to satisfy, as FIGS. 1 and 2 clearly reveal. Nevertheless, the horizontal section B—B forms a right angle, since the portion W-1 thereof lies directly behind the edge 28 (from the vantage point of FIG. 2).

At Section C—C, the entire left half of the web (from the vantage point of FIG. 2) has begun to fold to the rear, and the web takes the form of the right-angled V.

At Section D—D, the edge 32 (FIGS. 1 and 2) completes the folding of a portion W-1*a*, and a portion W-1*b* lies directly behind the edge 32 (from the vantage point of FIG. 2).

At Section E—E, which is tangent to the roller 18, the folding of the web is complete.

In FIG. 4, the plate 30 with its edge 32 is replaced by a bar 32' which serves as a guide means for the same purpose. A projection of the edge 32 or bar 32' onto the plane of the first triangle I is parallel to a line connecting the second and third points 2nd and 3rd. Moreover, the projections of the edges 28 and 32 (FIGS. 1 and 2) or bars 28' and 32' (FIG. 4) onto the plane of triangle I are substantially collinear and together correspond to the hypotenuse h of triangle I. In the embodiment of FIG. 4, it is not necessary to provide a bar corresponding to the edge 33, since the edge 33 does not engage the web W.

Apparatus like the apparatus 10 can be employed downstream thereof to receive the folded web W and effect an additional folding thereof.

Thus, there is provided in accordance with the invention a novel and highly effective apparatus and method for folding sheet materials such as plastic film. Many modifications of the preferred embodiments disclosed herein will readily occur to those skilled in the art. In particular, the angles $\phi$ and $\theta$ can be different on different apparatus, so long as the relationships set forth above, particularly the similar triangles I, II and III, are maintained. Accordingly, the invention includes all embodiments thereof which are within the scope of the appended claims.

What is claimed is:

1. Apparatus for automatically effecting a widthwise folding of a long, flexible web advanced therethrough comprising first training means, said web being trained about said first training means before said folding, second training means mounted in spaced-apart relation to said first training means, said web being trained about said second training means after said folding, and displacement means mounted in a fixed location between said first and second training means, a portion of said web being trained about said displacement means during said folding, said displacement means including at least one folding edge (i) approximately equidistant between said first and second training means, (ii) substantially parallel to the axes of said first and second training means, and (iii) spaced a predetermined distance from the plane in which said axes lie, said predetermined distance being approximately equal to the width of the folded film, with one end of said folding edge terminating at a point corresponding to the desired fold line of the web, such that:

(a) a first triangle is defined by a first point where a first edge of said web intersects said first training means, a second point where the same edge of said web intersects said second training means, and a third point where the opposite edge of said web intersects said first training means, (b) a second triangle is defined by said first point, a fourth point where said first edge of said web intersects said one folding edge of said displacement means, and a fifth point midway between said first and second points, and (c) a third triangle is defined by said second, fourth and fifth points, said triangles being similar and the distance between said fourth and fifth points being half the distance between said first and third points.

2. Apparatus according to claim 1 wherein said first training means comprises a first roller and said second training means comprises a second roller mounted in parallel relation thereto and further comprising adjustment means for accommodating webs of different widths by adjusting the positions of said first and second training means without changing the shapes of said triangles.

3. Apparatus according to claim 2 wherein said displacement means comprises a first bar mounted in parallel relation to said first and second rollers.

4. Apparatus according to claim 2 wherein said displacement means comprises a plate.

5. Apparatus according to claim 4 wherein said plate contains a second folding edge a projection of said second folding edge onto the plane of said first triangle lying substantially on a line connecting said second and third points.

6. Apparatus according to claim 2 further comprising guide means operative between said first folding edge and said second roller to facilitate the completion of said folding.

7. Apparatus according to claim 6 wherein said guide means comprises a bar of which a projection onto the plane of said first triangle lies substantially on a line connecting said second and third points.

8. Apparatus according to claim 6 wherein said guide means comprises a plate having an edge of which a projection onto the plane of said first triangle lies substantially on a line connecting said second and third points.

9. Apparatus according to claim 2 wherein said adjustment means comprises means for moving said first roller in a direction parallel to a line connecting said first and fourth points and said second roller in a direction parallel to a line connecting said second and fourth points.

10. A method of effecting a widthwise folding of a long, flexible web, comprising the steps of training said web about first elongated training means at a first location before said folding, training said web about second elongated training means at a second location spaced apart from said first location after said folding, training a portion of said web about a fixed displacement means at a fixed location equidistant from said first and second training means during said folding, said fixed displacement means comprising a fixed folding edge parallel to the axes of said first and second training means and spaced a predetermined distance from the plane in which said axes lie, said predetermined distance being approximately equal to the width of the folded film, with one end of said folding edge terminating at a point corresponding to the desired fold line of the web such that:

a first triangle is defined by a first point where a first edge of said web intersects said first training means, a second point where the same edge of said web intersects said second training means, and a third point where the opposite edge of said web intersects said first training means, a second triangle is defined by said first point, a fourth point where said first edge of said web intersects said displacement means, and a fifth point midway between said first and second point, and a third triangle is defined by said second, fourth and fifth points, said triangles being similar and the distance between said fourth and fifth points being half the distance between said first and third points, and accommodating webs of different widths by adjusting the positions of said first and second training means without changing the shapes of said triangles or moving said folding edge.

11. A method according to claim 10 wherein the adjusting of said positions comprises the steps of moving said first training means in a direction parallel to a line connecting said first and fourth points and said second training means in a direction parallel to a line connecting said second and fourth points.

12. A method according to claim 11 wherein said first training means and said second training means are moved through equal distances.

13. Apparatus for continuously folding a flexible web, comprising:

an entrance roller for receiving the unfolded film, an exit roller for removing the folded film, folding means including three fixed folding edges positioned between said rollers, one of said folding edges being parallel to the axes of said rollers, equidistant from said axes and a predetermined distance from the plane in which said axes lie, with one end of said one folding edge terminating at a point corresponding to the fold line of the folded web, a second of said folding edges extending at an acute angle from the entrance roller to said one end of said one folding edge, and the third of said edges extending from said one end of said one folding edge to the exit roller, the second and third folding edges lying in a plane forming a predetermined acute angle with said roller axes.

14. Apparatus for continuously folding a flexible web according to claim 13, wherein said predetermined distance is approximately equal to the width of the folded film.

15. Apparatus according to claim 14 wherein said first and second folding edges are defined by a fixed plate.

16. Apparatus according to claim 15 wherein said third edge is defined by a fixed plate.

* * * * *